US008616387B2

(12) United States Patent
Romeiro et al.

(10) Patent No.: US 8,616,387 B2
(45) Date of Patent: Dec. 31, 2013

(54) OVER HEAD CATEGORY FRAME SYSTEM

(75) Inventors: Raul Romeiro, West Chester, OH (US); Michael A. Serraino, Cincinnati, OH (US)

(73) Assignee: Innomark Communications, Fairfield, OH (US)

( * ) Notice: Subject to any disclaimer, the term of this patent is extended or adjusted under 35 U.S.C. 154(b) by 730 days.

(21) Appl. No.: 12/730,575

(22) Filed: Mar. 24, 2010

(65) Prior Publication Data

US 2010/0243587 A1 Sep. 30, 2010

Related U.S. Application Data

(60) Provisional application No. 61/163,288, filed on Mar. 25, 2009.

(51) Int. Cl.
*G09F 7/10* (2006.01)

(52) U.S. Cl.
USPC ..... 211/183; 40/601

(58) Field of Classification Search
USPC ..... 211/99, 169, 169.1, 170, 171, 183, 189; 312/138.1, 139, 234.3, 234.5, 327, 312/328; 40/601, 606.15
See application file for complete search history.

(56) References Cited

U.S. PATENT DOCUMENTS

| | | | | | |
|---|---|---|---|---|---|
| 2,849,270 | A * | 8/1958 | Warnock | 312/328 |
| 4,981,225 | A * | 1/1991 | Cole | 211/183 |
| 5,170,829 | A * | 12/1992 | Duncan et al. | 160/84.02 |
| 5,526,944 | A * | 6/1996 | Merl | 211/87.01 |
| 5,803,420 | A * | 9/1998 | Conway et al. | 248/231.41 |
| 5,860,537 | A * | 1/1999 | Loew | 211/104 |
| 5,924,367 | A | 7/1999 | Henke et al. | |
| 5,984,121 | A * | 11/1999 | Cole | 211/183 |
| 6,003,697 | A * | 12/1999 | Ferchat et al. | 211/189 |
| 6,102,496 | A * | 8/2000 | Parham | 312/138.1 |
| 6,234,329 | B1 * | 5/2001 | Loew | 211/104 |
| 6,318,684 | B1 * | 11/2001 | Ireland et al. | 248/201 |
| 6,457,689 | B1 * | 10/2002 | Padiak et al. | 248/291.1 |
| 6,470,611 | B1 * | 10/2002 | Conway et al. | 40/606.14 |
| 6,609,621 | B2 * | 8/2003 | Denny et al. | 211/189 |
| 6,665,969 | B1 * | 12/2003 | Conway | 40/605 |
| 6,698,604 | B2 * | 3/2004 | Denny et al. | 211/189 |
| 6,722,512 | B2 * | 4/2004 | Scully | 211/183 |
| 6,837,388 | B2 * | 1/2005 | Calleja | 211/183 |
| 6,877,621 | B1 * | 4/2005 | May et al. | 211/183 |
| 7,143,534 | B2 * | 12/2006 | Kaminski | 40/606.15 |
| 7,191,907 | B2 * | 3/2007 | Conway | 211/180 |
| 2002/0144966 | A1 * | 10/2002 | Calleja | 211/183 |
| 2002/0148799 | A1 * | 10/2002 | Denny et al. | 211/186 |
| 2004/0020886 | A1 * | 2/2004 | Scully | 211/183 |
| 2005/0097796 | A1 * | 5/2005 | Kaminski | 40/606.15 |
| 2005/0263470 | A1 * | 12/2005 | Horneland | 211/183 |
| 2006/0026876 | A1 * | 2/2006 | Murphy et al. | 40/601 |
| 2006/0213850 | A1 * | 9/2006 | VanCalbergh et al. | 211/94.01 |

* cited by examiner

*Primary Examiner* — Joshua Rodden
(74) *Attorney, Agent, or Firm* — Dinsmore & Shohl LLP

(57) ABSTRACT

A device and method for providing selective concealment and access to items stored on an overhead part of a retail shelving system. The device includes one or more mounting posts attachable to the retail shelving system and one or more panel support units. The mounting posts further include one or more substantially vertical channels. The panel support unit is engaged with the mounting posts and extends above the retail shelving system. The panel support unit is selectively moveable between an open configuration and a closed configuration such that when in the open configuration the panel support unit is displaced to provide access to the items stored on the overhead part of the retail shelving system, and when in the closed configuration the panel support unit conceals the items stored on the overhead part of the retail shelving system.

19 Claims, 12 Drawing Sheets

OVER HEAD CATEGORY FRAME SYSTEM

This application claims priority to U.S. Provisional Application Ser. No. 61/163,288, filed Mar. 25, 2009.

TECHNICAL FIELD

The present invention is generally directed to a framing system for retail shelving systems, and more specifically to a framing system for providing selective concealment and access to items stored on an overhead part of a retail shelving system.

BACKGROUND

Retail stores require large amounts of shelving both to display items and to store inventory. As a result, gondola shelving systems are commonly employed in the retail industry. Gondola shelving systems comprise metal shelves attached to slotted upright support beams. In response to the widespread usage of gondola shelving systems, framing systems have been designed to improve the appeal and appearance of existing gondola shelving systems.

Framing systems provide a structure wherein graphic signs may be displayed over the front portion of a gondola shelving system, serving both to display graphics and to conceal items stocked within the existing body of the shelving system. While many framing systems also translate to provide access to items concealed behind the graphic signs, these framing systems are aimed primarily at covering stocked items stored within the body of the shelving system and fail to address overhead stock items stored on the uppermost shelf of the gondola shelving system. Thus, improvements to overhead category frame systems are desired.

SUMMARY

The present invention relates to a device and method for providing selective concealment and access to items stored on an overhead part of a retail shelving system. The device comprises a plurality of mounting posts (i.e. mounting members) attachable to the retail shelving system and at least one panel support unit configured to hold a panel therein. The plurality of mounting posts further comprise at least one substantially vertical channel terminating in respective ends thereof and extending in a substantially vertical direction above the retail shelving system. The panel support unit is engaged with the plurality of mounting posts and extends above the retail shelving system. The panel support unit is selectively moveable between an open configuration and a closed configuration, such that when in the open configuration the panel support unit is displaced to provide access to the items stored on the overhead part of the retail shelving system, and when in the closed configuration the panel support unit conceals the items stored on the overhead part of the retail shelving system.

The present invention also relates to a retail shelving system. The retail shelving system includes a plurality of substantially vertical posts attached to at least one substantially horizontal shelf, a plurality of mounting posts, and at least one panel support unit configured to hold a panel therein. The substantially vertical posts are substantially normal to the substantially horizontal shelf. Each of the plurality of mounting posts extend in a substantially vertical direction above the retail shelving system and comprise at least one substantially vertical channel terminating in respective ends thereof. The panel support unit is engaged with the plurality of mounting posts and extends above the retail shelving system. The panel support unit is selectively moveable between an open configuration and a closed configuration, such that when in the open configuration the panel support unit is displaced to provide access to the items stored on the overhead part of the retail shelving system, and when in the closed configuration the panel support unit conceals the items stored on the overhead part of the retail shelving system.

In another aspect, the present invention relates to a method of storing items on an overhead part of a retail shelving system. The method comprises providing a plurality of mounting posts attachable to the retail shelving system comprising at least one substantially vertical channel terminating in respective ends thereof and extending in a substantially vertical direction above the retail shelving system. The method further comprises providing at least one panel support unit configured to hold a panel therein, wherein the panel support unit is engaged with the plurality of mounting posts, and wherein the panel support unit extends above the retail shelving system and is selectively moveable between an open configuration and a closed configuration, wherein displacing the panel support unit provides access to the items stored on the overhead part of the retail shelving system.

In yet another embodiment, a method of providing selective concealment and access to items stored on an overhead part of a retail shelving system which comprises utilizing the device of the present invention is disclosed.

These and other features and advantages of these and other various embodiments according to the present invention will become more apparent in view of the drawings, detailed description, and claims provided that follow hereafter.

BRIEF DESCRIPTION OF THE DRAWINGS

The following detailed description of the embodiments of the present invention can be best understood when read in conjunction with the following drawings, where like structure is indicated with like reference numerals, and in which.

Skilled artisans appreciate that elements in the figures are illustrated for simplicity and clarity and have not necessarily been drawn to scale. For example, the dimensions of some of the elements in the figures may be exaggerated relative to other elements, as well as conventional parts removed, to help to improve understanding of the various embodiments of the present invention.

DETAILED DESCRIPTION

The present invention comprises a device for providing selective concealment and access to items stored on an overhead part of a retail shelving system. The device comprises a plurality of mounting posts attachable to the retail shelving system and at least one panel support unit configured to hold a panel therein. The panel support unit is engaged with the plurality of mounting posts and extends above the retail shelving system. The panel support unit may be displaced to provide access to items stored on the overhead part of the retail shelving system. The present invention further comprises a retail shelving system comprising a shelving system, a plurality of mounting posts, and at least one panel support unit. The present invention also relates to methods of storing items and utilization thereof.

Figure 1:
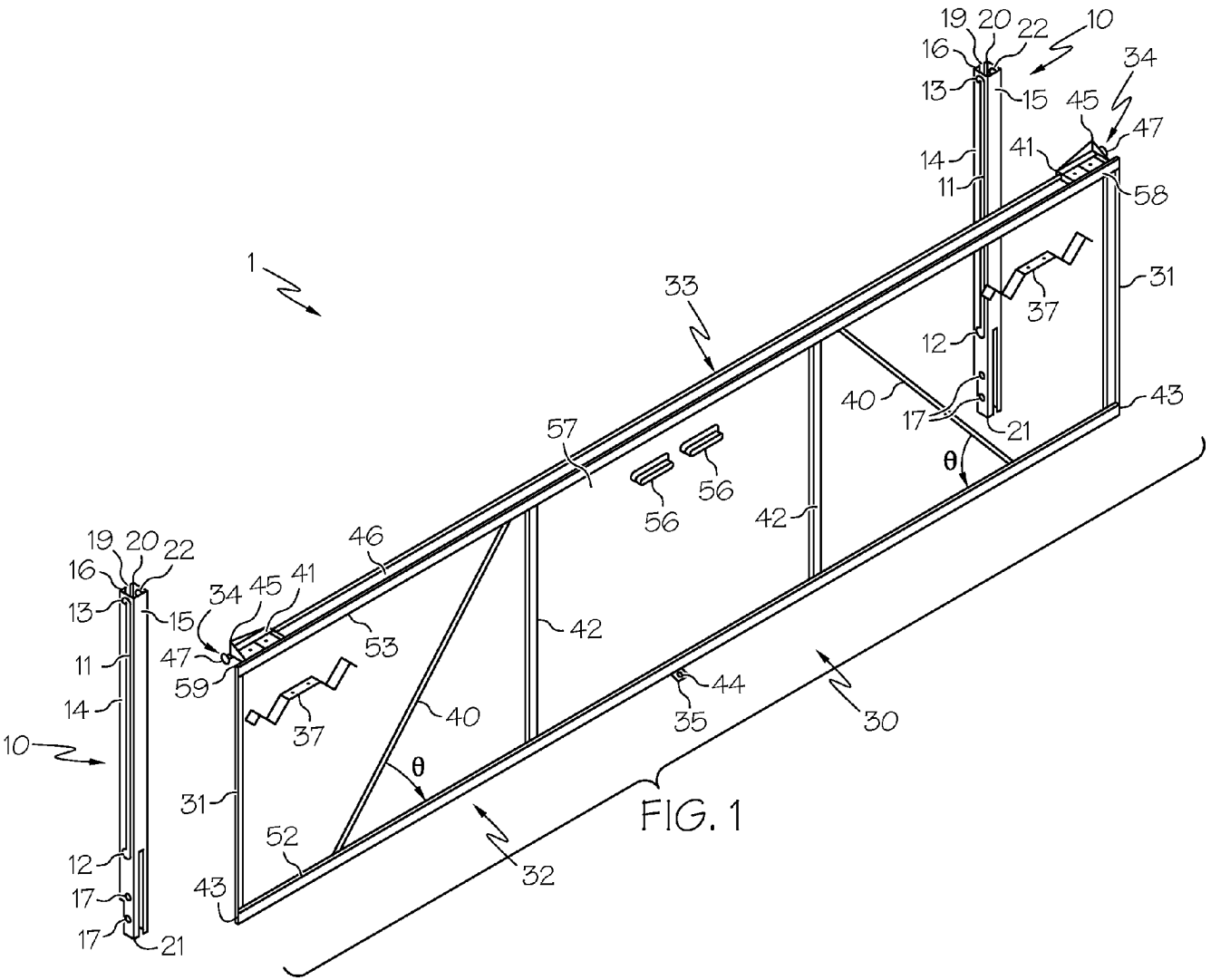
FIG. 1 is an exploded view of a device for providing selective concealment and access to items stored on an overhead part of a retail shelving system according to one embodiment of the present invention.

As depicted in FIG. 1, the device 1 for providing selective concealment and access to items stored on an overhead part of a retail shelving system comprises a plurality of mounting posts 10 and at least one panel support unit 30. The plurality of mounting posts 10 are attachable to the retail shelving system and comprise at least one substantially vertical channel 11 ending in respective ends thereof. The panel support unit 30 is configured to hold a panel 50 (shown in FIG. 7) therein. The panel support unit 30 is engaged with the plurality of mounting posts 10 and extends in a vertical direction above the retail shelving system. The panel support unit 30 is selectively moveable between an open configuration and a closed configuration, such that the open configuration provides access to items stored on the overhead part of the retail shelving system and the closed configuration conceals the items stored on the overhead part of the retail shelving system.

Figure 3A:
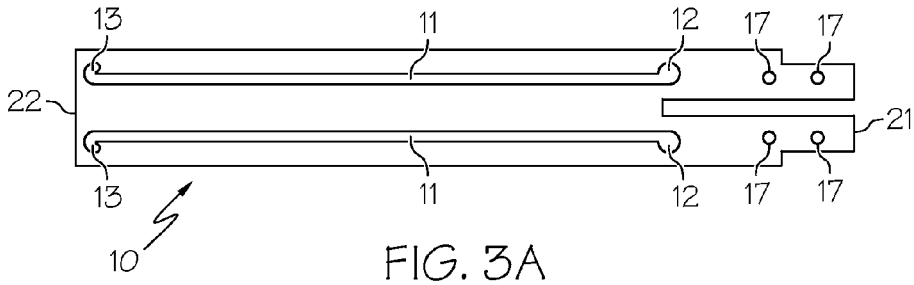
FIG. 3A is front view of a mounting post laid open in a template format of the device for providing selective concealment and access to items stored on an overhead part of the retail shelving system, wherein the mounting post is open in a template format, according to one embodiment of the present invention.
Figure 3B:
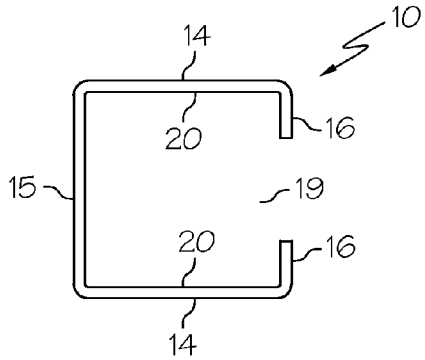
FIG. 3B is a top view of a mounting post of the device for providing selective concealment and access to items stored on an overhead part of the retail shelving system according to one embodiment of the present invention.
Figure 3C:
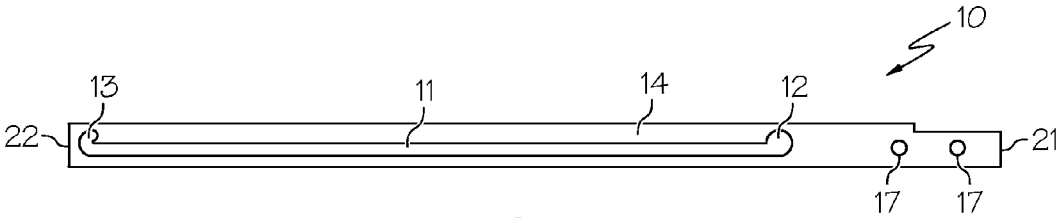
FIG. 3C is a side view of a mounting post of the device for providing selective concealment and access to items stored on an overhead part of the retail shelving system according to one embodiment of the present invention.
Figure 3D:
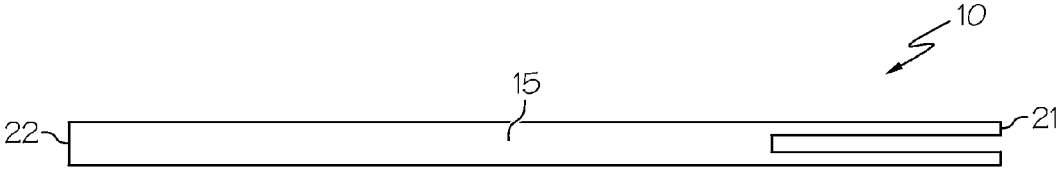
FIG. 3D is a front view of a mounting post of the device for providing selective concealment and access to items stored on an overhead part of the retail shelving system according to one embodiment of the present invention.

As depicted in FIGS. 2 and 3A-3D, in one embodiment, the plurality of mounting posts 10 are substantially C-shaped (it is understood by one skilled in the art that FIG. 3A is for clarification only, and that in application the mounting posts 10 are not laid open in a template format as depicted in FIG. 3A). In this particular embodiment, each of the plurality of mounting posts 10 comprise side walls 14 attached to a front wall 15, wherein the side walls 14 and the front wall 15 define a cavity 19. The side walls 14 are substantially parallel to one another and the front wall 15 is substantially normal to the side walls 14. The side walls 14 may further comprise a flange 16 that extends lengthwise along the inner edge 20 of the side walls 14 such that the flange 16 is substantially normal to the side walls 14. The flange 16 extends inwardly from the inner edge 20 of the side walls 14.

Figure 2:
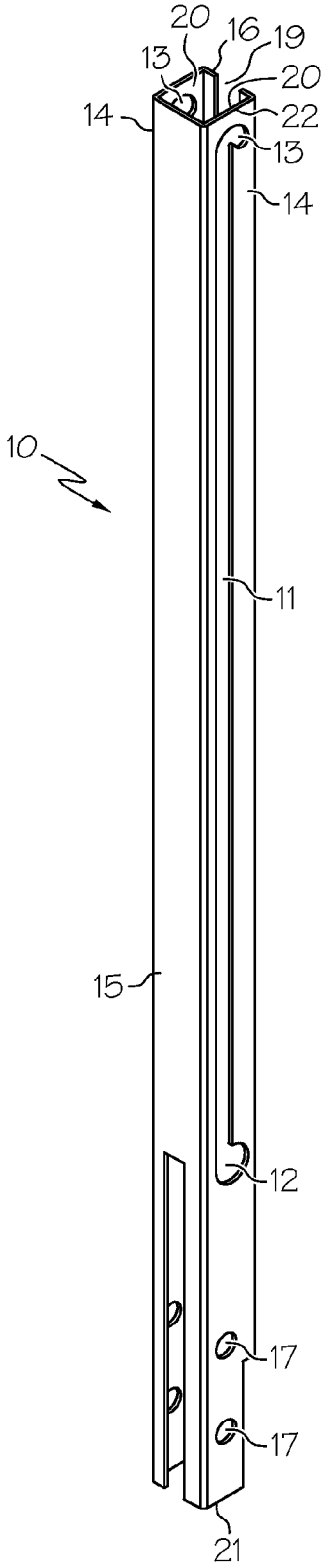
FIG. 2 is perspective view of a substantially C-shaped mounting post of the device for providing selective concealment and access to items stored on an overhead part of the retail shelving system according to one embodiment of the present invention.
Figure 2A:
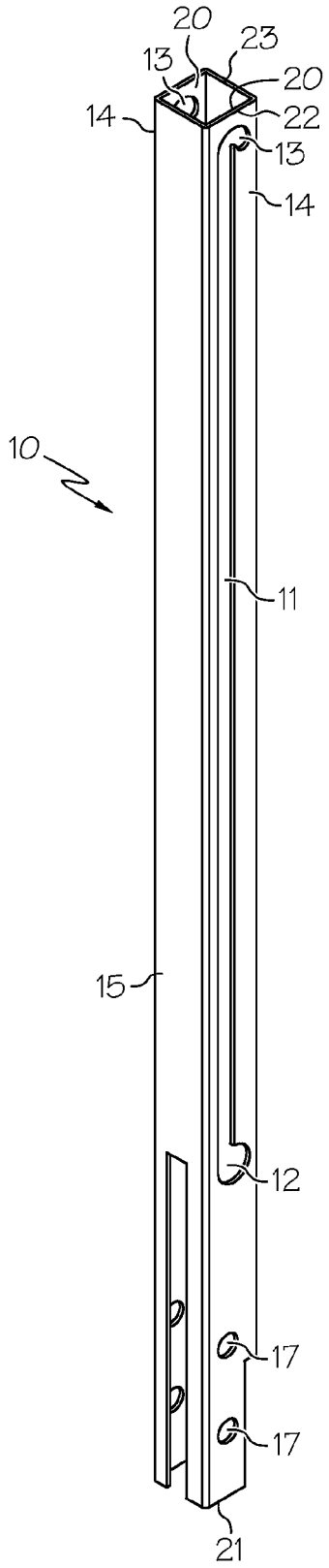
FIG. 2A is a perspective view of a substantially square-shaped mounting post of the device for providing selective concealment and access to items stored on an overhead part of the retail shelving system according to one embodiment of the present invention.

As depicted in FIG. 2A, in an alternative embodiment, the plurality of mounting posts 10 are substantially square-shaped. In this particular embodiment, each of the plurality of mounting posts 10 comprise side walls 14 attached to a front wall 15 and attached to a back wall 23, wherein the side walls 14, the front wall 15, and the back wall 23 define a cavity 19. The side walls 14 are substantially parallel to one another, the front wall 15 and the back wall 23 are substantially parallel to one another, and the front wall 15 and the back wall 23 are substantially normal to the side walls 14. The square-shaped mounting post 10 may offer increased strength and support to the panel support unit 30.

As shown in FIGS. 2, 2A, and 3A-3D, the side walls 14 define at least one substantially vertical channel 11 terminating in respective ends thereof such that the pair of substantially vertical channels 11 extend lengthwise through the side walls 14. In a further embodiment, the respective ends of the substantially vertical channels 11 terminate in a lower aperture 12 and an upper aperture 13. The lower aperture 12 comprises a substantially circular shape, and the upper aperture 13 comprises a substantially curved shape. The side walls 14 may further define at least one fastener-receiving aperture 17 wherein the plurality of mounting posts 10 may be attached to the retail shelving system. In one particular embodiment, the fastener-receiving aperture 17 may be defined within the lower one third of the side walls 14, such that the plurality of mounting posts 10 may be attached to the retail shelving system through at least one fastener coupled thereto through the at least one fastener-receiving aperture 17. The fastener may include, but should not be limited to, bolts, screws, nuts, and/or other fasteners (not shown).

The front wall 15 of each of the plurality of mounting posts 10 comprises a bottom edge 21 and a top edge 22. The plurality of mounting posts 10, as formed by side walls 14 and front wall 15, may accommodate the retail shelving system in a nested fashion. In an alternative embodiment, the plurality of mounting posts, as formed by side walls 14, front wall 15, and back wall 23, may accommodate the retail shelving system in a nested fashion.

The plurality of mounting posts 10 are attachable to the retail shelving system such that they extend in a vertical direction above the retail shelving system. In one embodiment, the retail shelving system comprises vertical posts with overhead shelving disposed therebetween, wherein the plurality of mounting posts 10 are attachable to the vertical posts. In one particular form, the vertical posts of the retail shelving system fit in a nested fashion within a portion of the cavity 19 defined by each of the plurality of mounting posts 10, such that a portion of the plurality of mounting posts 10 extends above the retail shelving system.

Figure 4:
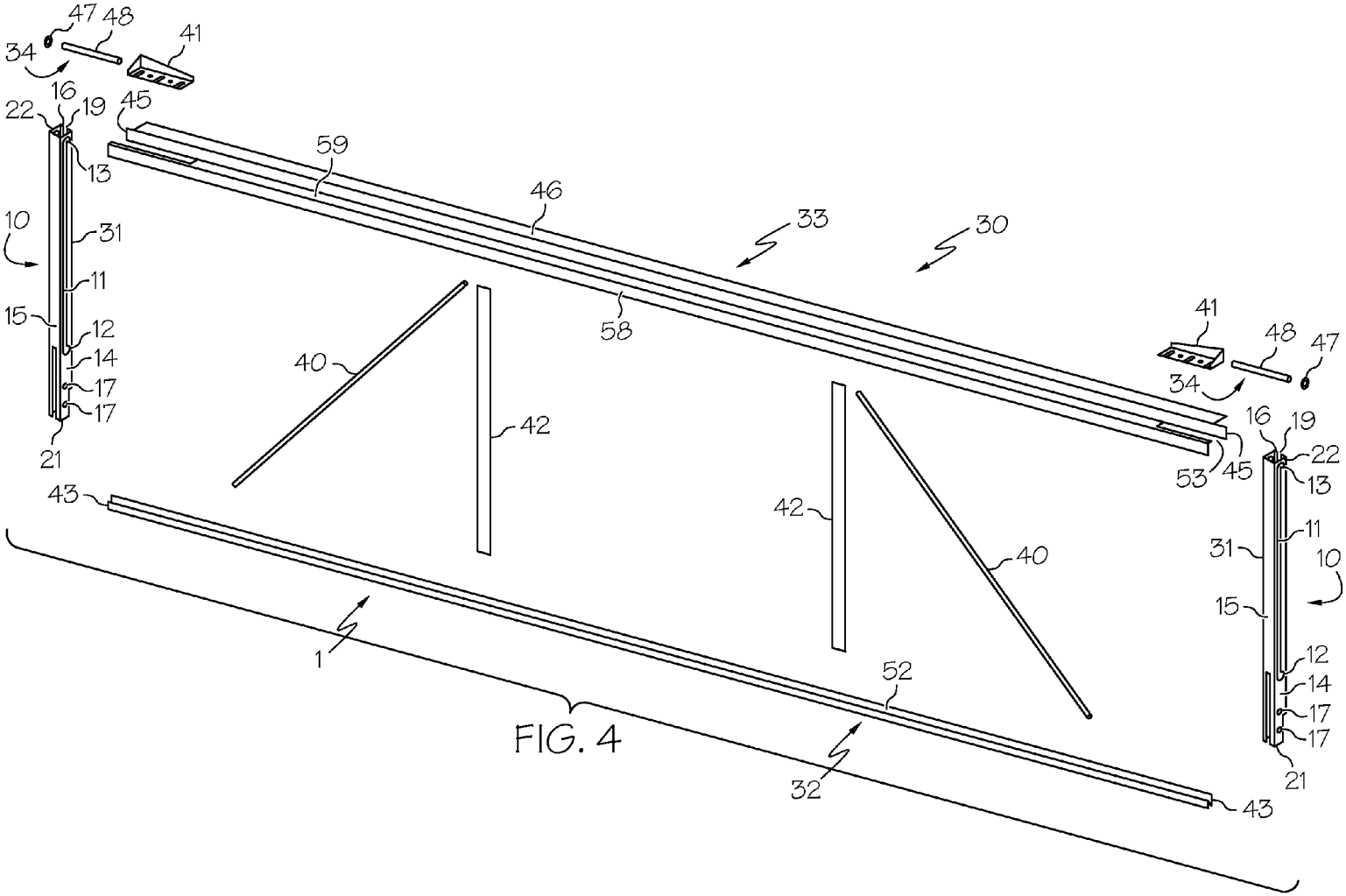
FIG. 4 is an exploded view of the panel support unit of the device for providing selective concealment and access to items stored on an overhead part of the retail shelving system according to one embodiment of the present invention.

As depicted in FIGS. 1 and 4, the panel support unit 30 comprises a generally frame-like structure made up of a pair of unusually-spaced members 31 connected to header members, 32 and 33. In one particular embodiment, the pair of unusually-spaced members 31 are substantially parallel to one another, as are the header members 32 and 33, and the pair of unusually-spaced members 31 are substantially normal to the header members, 32 and 33, such that the panel support unit 30 is substantially rectangular. The length of the pair of unusually-shaped supporting members 31 is less than the length of plurality of mounting posts 10. In still a further embodiment, the header members 32 and 33 comprise elongated structures of substantially the same length. Similarly, the unusually-shaped members 31 comprise elongated structures of substantially the same length. As used herein, the term "elongated structure" refers to a structure having a greater length than width. In yet still a further embodiment, the length of the header members 32 and 33 is substantially the same as that of the overhead part of the retail shelving system which extends between the vertical posts of the retail shelving system.

In a further embodiment, the panel support unit 30 may comprise inner support members 42 arranged within the panel support unit 30 such that they are substantially parallel to the pair of unusually-spaced members 31. In this particular embodiment, the inner support members 42 comprise elongated structures of substantially the same length as the pair of unusually-spaced members 31. The panel support unit 30 may further comprise supplemental support members 40 which may be arranged within the panel support unit 30 in a non-parallel manner. In one particular embodiment, the supplemental support members 40 may be attached to the header members 32, 33 such that they extend from the header member 32 toward the inner support members 42, forming an acute angle θ with the header member 32. The supplemental support members 40 may comprise elongated structures.

Figure 5:
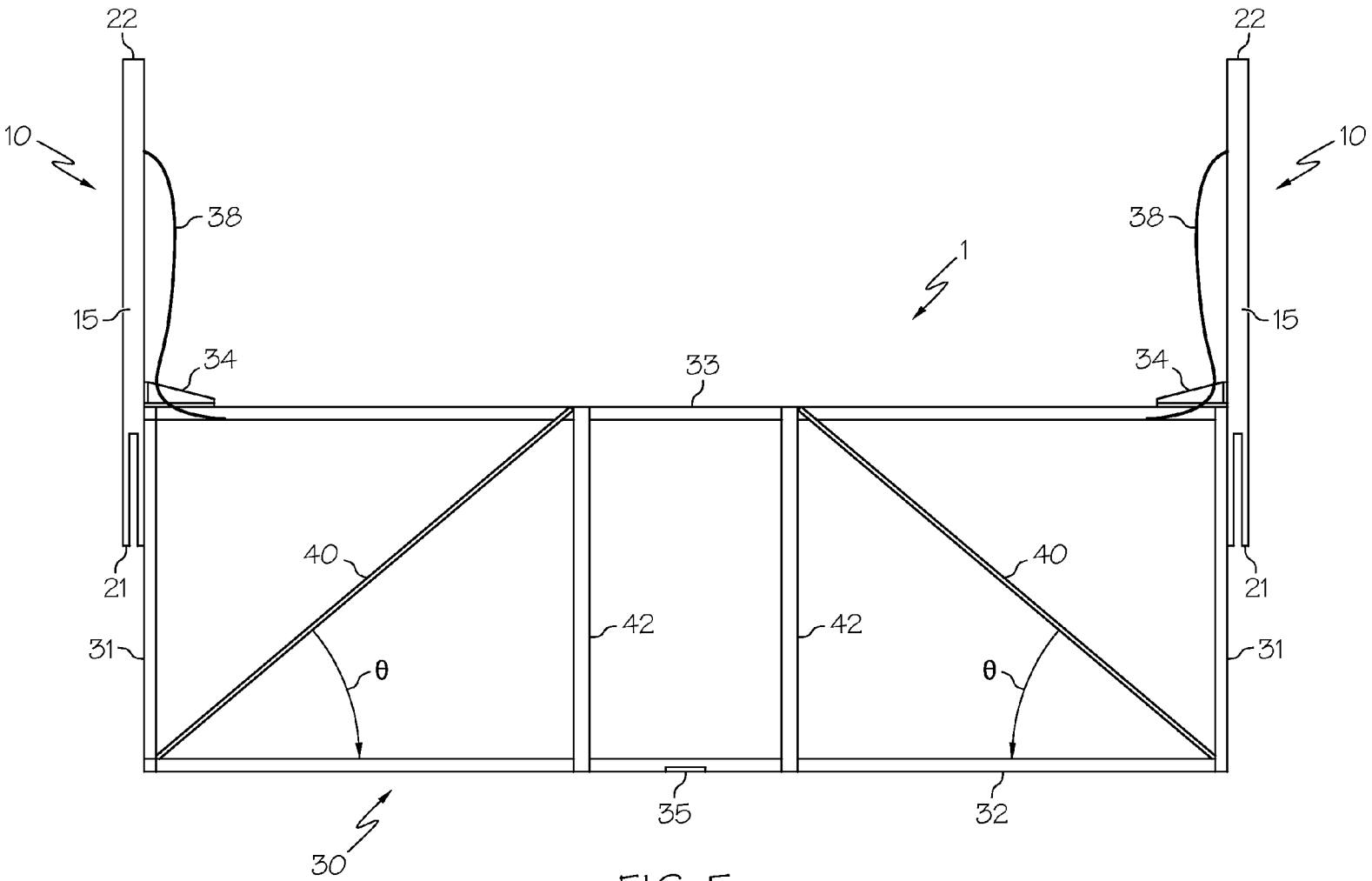
FIG. 5 is a front view of the open configuration of the device for providing selective concealment and access to items stored on an overhead part of the retail shelving system, wherein the panel support unit was displaced in a vertical direction, according to one embodiment of the present invention.
Figure 5A:
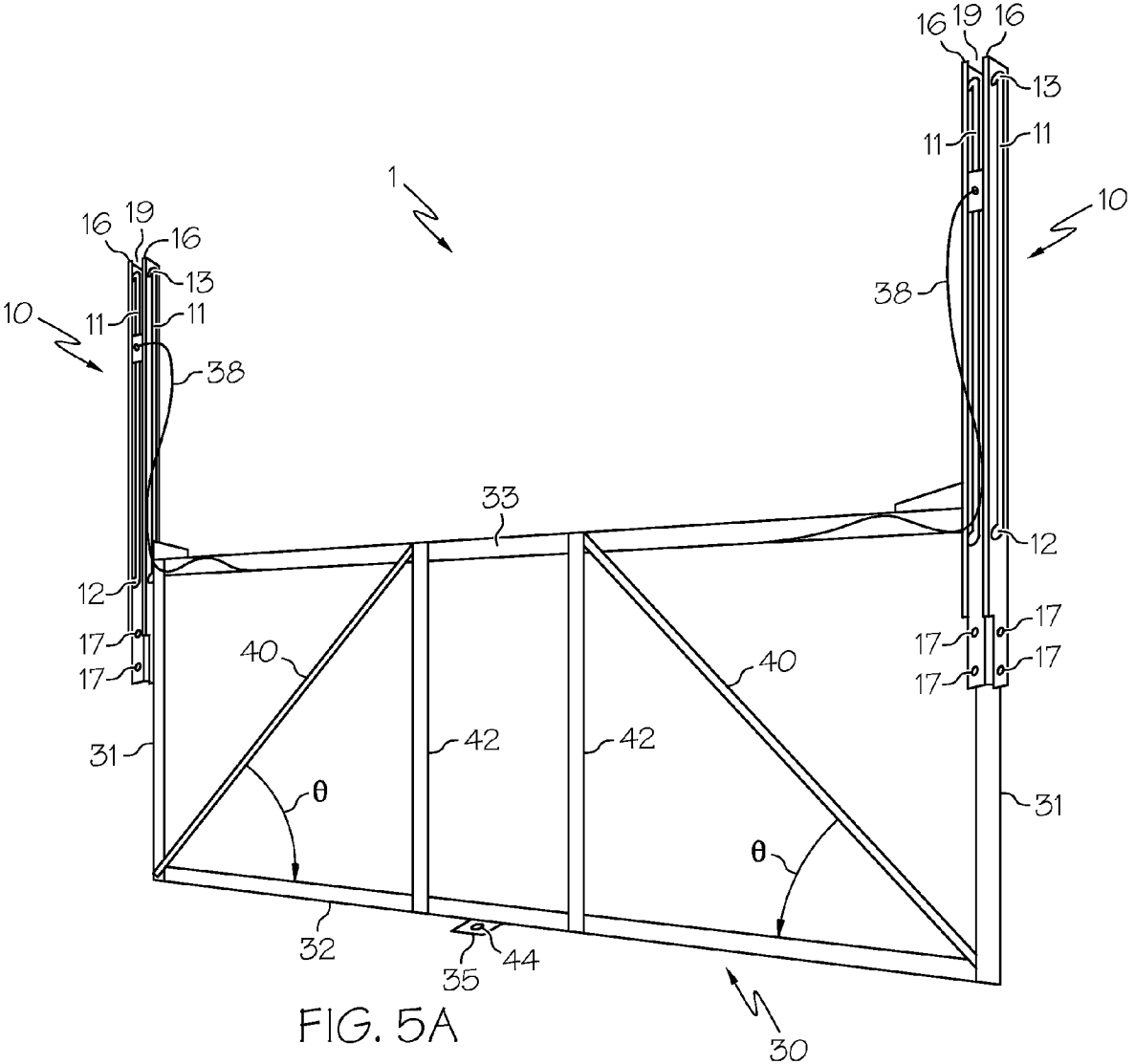
FIG. 5A is a back perspective view of the open configuration of the device for providing selective concealment and access to items stored on an overhead part of the retail shelving system, wherein the panel support unit was displaced in a vertical direction, according to one embodiment of the present invention.

As depicted in FIGS. 1, 5, and 5A, the panel support unit 30 may further comprise a tab member 35. In one particular embodiment, the tab member 35 may be centrally attached to the header member 32, such that it is substantially equidistant from the outside edges 43 of the header member 32. The tab member 35 may be attached to the header member 32 with any attachment devices, including but not limited to screws, nuts, bolts, clamps, and/or welds. In one particular embodiment, the tab member 35 may be substantially L-shaped, although the tab member 35 may comprise any shape with a portion thereof that extends from the header member 32.

In a further embodiment, the tab member 35 defines at least one aperture 44, wherein a post 36 may be inserted through the at least one aperture 44 to displace the panel support unit 30. In one particular embodiment, the at least one aperture 44 may be defined by the portion of the tab member 35 extending from the header member 32. In a further embodiment, the at least one aperture 44 may be substantially circular. The shape of the at least one aperture 44 defined by the tab member 35 should not be limited to a substantially circular shape, however, as the at least one aperture 44 may comprise any shape through which a post 36 may be inserted to displace the panel support unit 30.

Again referring to FIG. 4, the panel support unit 30 further comprises at least two pins 34. The pins 34 extend beyond the perimeter of the panel support unit 30. In one particular embodiment, the pins 34 comprise a substantially circular head 47 and a substantially cylindrical post 48. The pins 34 are attached to the header member 33, such that they extend outwardly from the outside edges 45 of the header member 33. In this way, the substantially cylindrical post 48 of the pins 34 is substantially parallel to the length of the header member 33. The pins 34 may be attached to the header member 33 with any securing mechanism, including but not limited to screws, nuts, bolts, clamps, and/or welds. In one exemplary embodiment, the pins 34 are welded onto the header member 33. In a further embodiment, the pins 34 may be attached to the header member 33 with at least two brackets 41. In this embodiment, the brackets 41 may be attached to the upper edge 46 of the header member 33. The brackets 41 may be attached to the header member 33 with any attachment devices which will secure the brackets 41 to the header member 33, including but not limited to screws, nuts, bolts, clamps, and/or welds.

Figures 6, 6A:
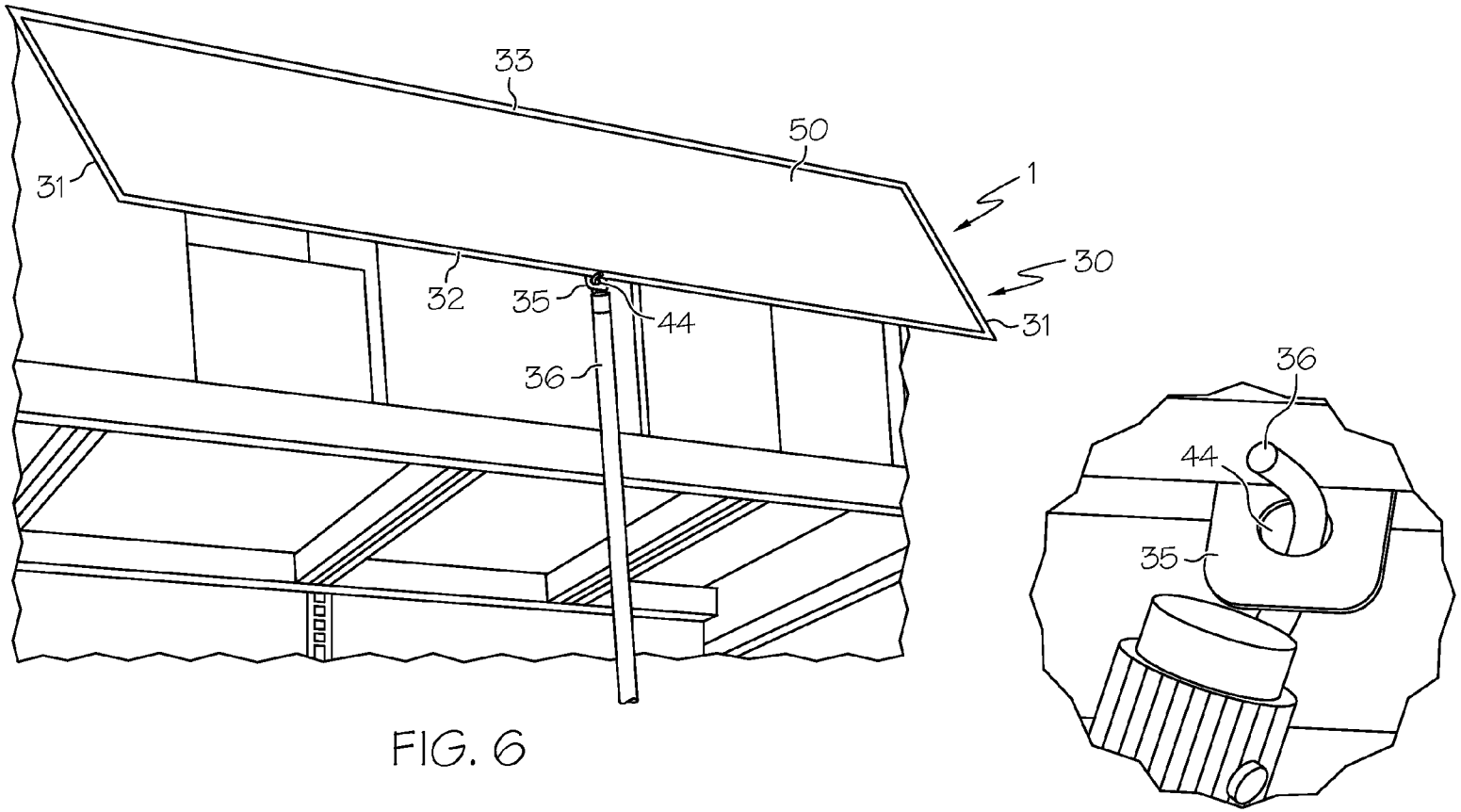
FIG. 6 is a perspective view of the open configuration of the device for providing selective concealment and access to items stored on an overhead part of the retail shelving system, wherein the panel support unit was displaced in a radial direction, according to one embodiment of the present invention.
FIG. 6A is a perspective view of a post inserted through at least one aperture defined by the tab member of the panel support unit of the device for providing selective concealment and access to items stored on an overhead part of the retail shelving system according to one embodiment of the present invention.

With regard to FIG. 6, the panel support unit 30 is configured to hold a panel 50 therein. In one particular embodiment, the panel 50 is accommodated by the panel support unit 30 such that it fits complementarily within the panel support unit 30. The header members 32, 33, may comprise a substantially C-shaped structure, wherein header member cavities 52, 53 are defined. In this particular embodiment, the header member 33 may comprise side walls 58 and a top wall 59. Thus, the panel 50 may be held within the header member cavities 52, 53.

The panel 50 may be arranged within the panel support unit 30 by placing the upper edge (not shown) of the panel 50 into the header member cavity 52 and placing the lower edge (not shown) of the panel 50 into the header member cavity 53. In one particular embodiment, the panel support unit 30 may be slightly larger than the panel 50 to allow arrangement of the panel 50 within the panel support unit 30. However, the panel support unit 30 should be configured not only to allow arrangement of the panel 50 within, but also to hold the panel 50 in a substantially fixed position, such that the panel 50 does not fall upon rotation or translation of the panel support unit 30. In a further embodiment, the panel support unit 30 should be configured to hold the panel 50 in a fixed position such that the panel 50 does not fall out of the panel support unit 30 as a result of the panel support unit 30 being dropped.

In still a further embodiment, the panel support unit 30 may comprise support pads 56. The support pads 56 may comprise but should not be limited to plastics, polymers, composites, other materials, additives, and/or combinations thereof. In one particular embodiment, the support pads 56 comprise rubber. The support pads 56 may be arranged within the panel support unit 30 to provide pressure and friction to the panel 50, such that the panel 50 does not fall out of the panel support unit 30 even after being repeatedly dropped. In one particular embodiment, the support pads 56 may be attached to a panel 57. In a further embodiment, the panel 57 may be attached to the panel support unit 30 such that it is attached to the inner support members 42. The panel 57 may be attached to the inner support members 42 with any attachment devices which will secure the panel 57 to the inner support members 42, including but not limited to screws, nuts, bolts, and/or clamps. Alternatively, the panel 57 may be attached to any portion of the panel support unit 30 wherein the support pads 56 may provide pressure and friction to the panel 50.

It is understood that the panel 50 may comprise various text, graphics, images, and/or advertisements; it is also understood that the panel 50 may be blank. It is also understood by one skilled in the art that the text, graphics, images and/or advertisements may be painted, drawn, screened, stenciled, or affixed to the panel 50. In one embodiment, the panel 50 held within the panel support unit 30 is not permanently fixed to the panel support unit 30, such that the panel 50 may be interchanged with a different graphic indicia. In this way, the text, graphics, images, advertisements or lack thereof displayed on the panel 50 may be changed according to need.

As depicted in FIGS. 5 and 5A, the panel support unit 30 may engage the plurality of mounting posts 10. In one embodiment, the pins 34 of the panel support unit 30 may engage the pair of substantially vertical channels 11 of the plurality of mounting posts 10. The pins 34 may engage the pair of substantially vertical channels 11 through the lower aperture 12. In this particular embodiment, the diameter of the substantially circular lower aperture 12 is greater than the diameter of the substantially circular head 47 of the pins 34 such that the pins 34 of the panel support unit 30 may be inserted into the lower aperture 12, allowing the panel support unit 30 to engage the plurality of mounting posts 10.

Figure 5B:
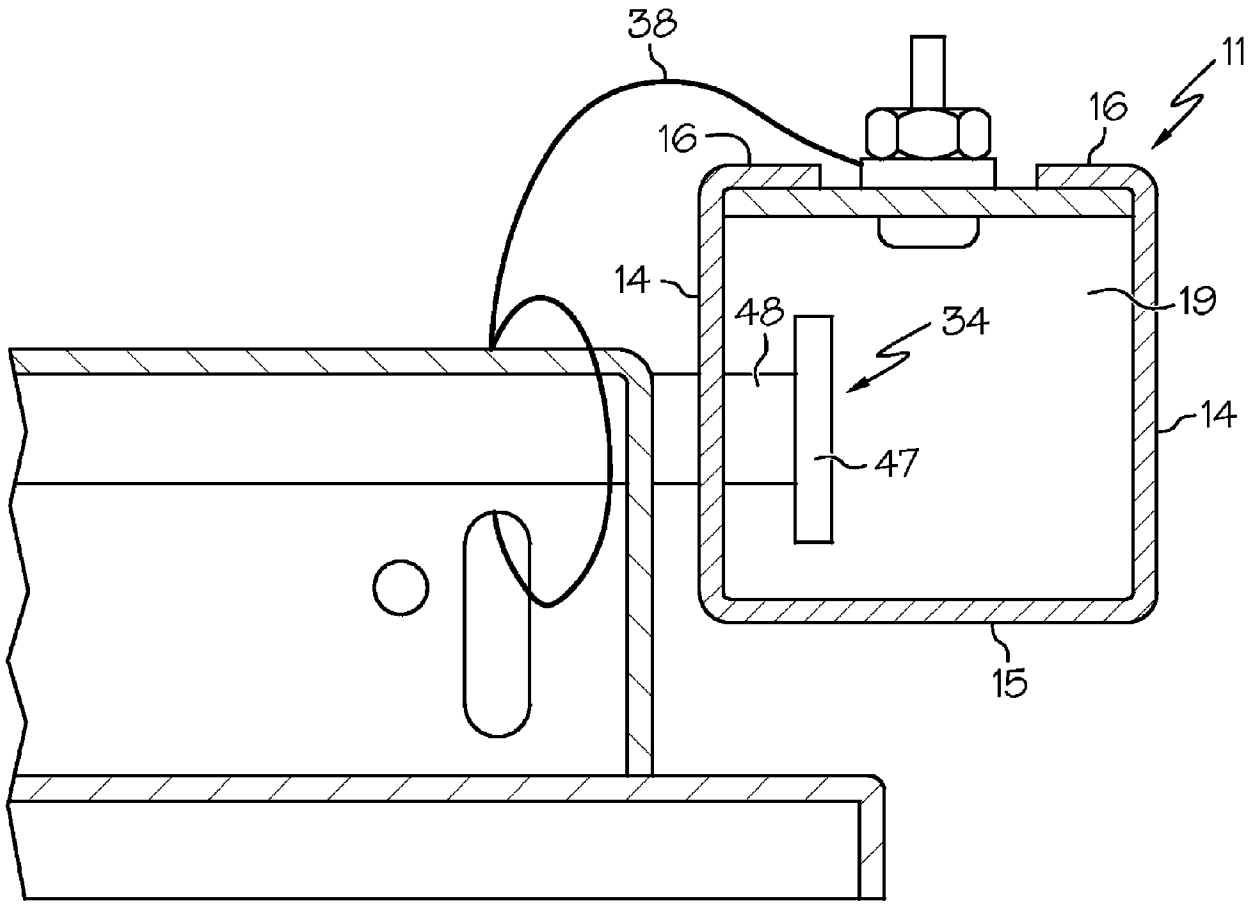
FIG. 5B is a top view of the mounting post attached to a cable of the device for providing selective concealment and access to items stored on an overhead part of the retail shelving system according to one embodiment of the present invention.

Referring to FIGS. 5, 5A, and 5B, the device 1 for providing selective concealment and access to items stored on an overhead part of the retail shelving system may further comprise at least one cable 38. The cable 38 may serve as a safety device to ensure that the panel support unit 30 does not become disengaged from the plurality of mounting posts 10. The cable 38 may be attached to the plurality of mounting posts 10 and to the panel support unit 30, and more particularly to the header member 33 of the panel support unit 30. In one particular embodiment, the cable 38 may be attached to the flange 16 that extends lengthwise along the inner edge 20 of the side walls 14 of the plurality of mounting posts 10. In a further embodiment, the cable 38 may comprise a hook (not shown) that may be placed over a stud (not shown) attached to the flange 16 that extends lengthwise along the inner edge 20 of the side walls 14 of the plurality of mounting posts 10. The cable 38 may be similarly attached to the header member 33, wherein the cable 38 may comprise a hook (not shown) that may be placed over a stud (not shown). The cable 38 may be secured to the plurality of mounting posts 10 and the header member 33 with any suitable attachment devices, including but not limited to nails, screws, nuts, bolts, and/or clamps.

The device 1 for providing selective concealment and access to items stored on an overhead part of the retail shelving system may further comprise at least one spring pad 37, which may help to maintain the structural integrity of the panel support unit 30. If the panel support unit 30 is dropped, the spring pad 37 helps to maintain the structural integrity of the panel support unit 30 by dissipating the force of impact. In one particular embodiment, the spring pad 37 may be attached to the header member 33. In a further embodiment, the header member 33 may comprise a flange (not shown) which is substantially normal to the side walls 58 of the header member 33. In this particular embodiment, the spring pad 37 may be attached to the flange (not shown) of the header member 33. The spring pad 37 may be attached to the header member 33 with any suitable attachment devices, including but not limited to nails, screws, nuts, bolts, and/or clamps.

After the panel support unit 30 engages the plurality of mounting posts 10, pressure may be applied to the plurality of mounting posts 10 such that the plurality of mounting posts 10 translates downward in a vertical direction along the vertical posts of the retail shelving system. Pressure may be applied to the plurality of mounting posts 10 such that the lower apertures 12 engage the vertical posts of the retail shelving system in a nested fashion. In this particular embodiment, the lower apertures 12 may be obstructed by the vertical posts of the retail shelving system such that the panel support unit 30 may not engage the lower apertures 12. Thus, the panel support unit 30 may not disengage the plurality of mounting posts 10, and thus may not fall from the plurality of mounting posts 10. Thus, the translation of the plurality of mounting posts 10 in a downward vertical direction acts as a safety feature, preventing the panel support unit 30 from disengaging the plurality of mounting posts 10.

After the plurality of mounting posts 10 have translated downward in a vertical direction such that the lower apertures 12 are obstructed by the retail shelving system, the plurality of mounting posts 10 may be further secured to the retail shelving system by inserting suitable attachment devices through the at least one aperture 17 defined by the side walls 14, wherein the at least one aperture 17 defined by the side walls 14 aligns with at least one aperture defined by vertical posts of the existing retail shelving system. Suitable attachment devices may include but should not be limited to screws, nuts, bolts, and/or clamps.

Upon engaging the plurality of mounting posts 10, the panel support unit 30 is selectively moveable between an open configuration and a closed configuration. As depicted in FIGS. 5 and 5A, the open configuration comprises the displacement of the panel support unit 30 to provide access to the items stored on the overhead part of the retail shelving system. In one exemplary embodiment, the open configuration comprises the downward translation of the pins 34 through the pair of substantially vertical channels 11 such that the panel support unit 30 is not substantially above the retail shelving system. In this particular embodiment, items may be easily added to and removed from the overhead part of the retail shelving system. Thus, this particular embodiment of the open configuration comprises easy restock of the overhead part of the retail shelving system.

In another exemplary embodiment, as depicted in FIG. 6, the open configuration comprises rotation of the panel support unit 30 about its engagement with the upper aperture 13 such that the panel support unit 30 remains substantially above the retail shelving system. In this particular embodiment, the panel support unit 30 rotates outwardly in a radial direction such that the items stored on the overhead part of the retail shelving system are not concealed. In this embodiment of the open configuration, a quick inventory of the items previously concealed beneath the panel support unit 30 may be taken without requiring the complete translation of the panel support unit 30 through the pair of substantially vertical channels 11. With regard to FIGS. 5, 5A, 6, 6A, 8A, and 8B, in a further embodiment, a post 36 may be inserted through the at least one aperture 44 defined by the tab member 35 of the panel support unit 30, such that the application of pressure may result in the rotation of the panel support unit 30 about its engagement with the upper aperture 13. In still a further embodiment, the post 36 may comprise a curved structure such that it may be easily inserted through the at least one aperture 44 and such that pressure may be easily applied to the panel support unit 30, wherein resulting in the rotation of the panel support unit 30 about its engagement with the upper aperture 13. Thus, the previously concealed inventory may be easily and quickly checked.

Figure 7:
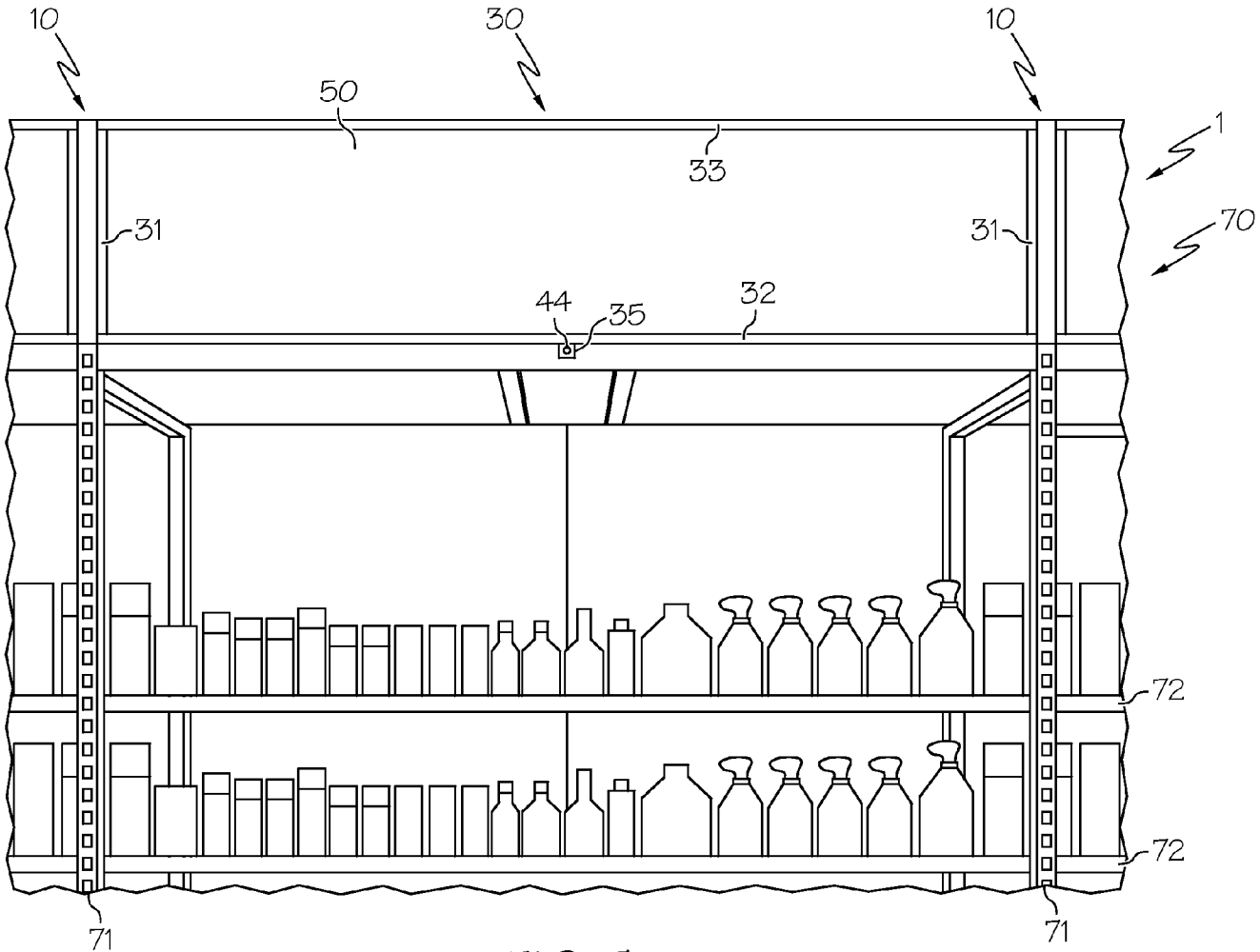
FIG. 7 is a front view of the closed configuration of the device for providing selective concealment and access to items stored on an overhead part of the retail shelving system according to one embodiment of the present invention.
Figure 8A:
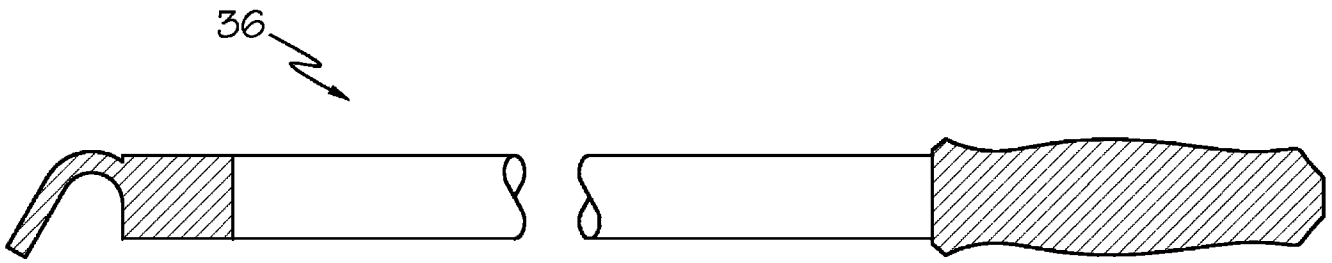
FIG. 8A is a front view of a post of the device for providing selective concealment and access to items stored on an overhead part of the retail shelving system according to one embodiment of the present invention.
Figure 8B:
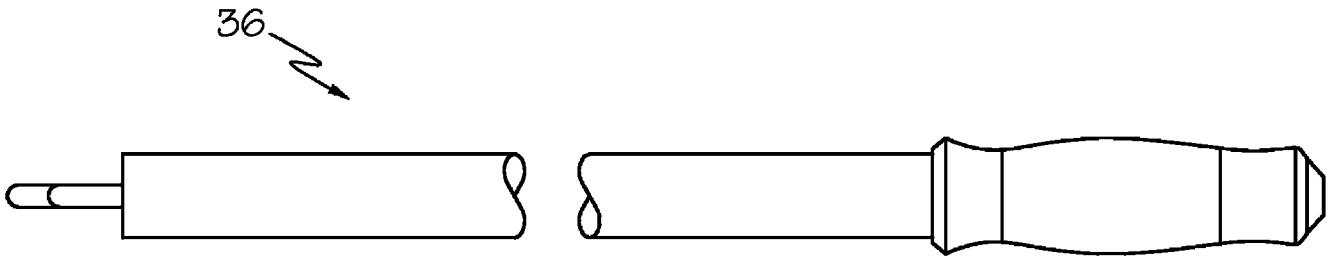
FIG. 8B is a top view of a post of the device for providing selective concealment and access to items stored on an overhead part of the retail shelving system according to one embodiment of the present invention.

As depicted in FIG. 7, in the closed configuration, the panel support unit 30 conceals the items stored on the overhead part of the retail shelving system. In the closed configuration, the pins 34 rest within the upper aperture 13, such that the panel support unit 30 extends in a vertical direction above the retail shelving system, thus concealing the items on the overhead part of the retail shelving system. In one embodiment of the closed configuration, the pins 34 may engage the upper aperture 13. In this particular embodiment, the upper aperture 13 is substantially curved such that when the pins 34 engage the upper aperture 13, the position of the panel support unit 30 is selectively fixed in a closed configuration. In this particular embodiment, the substantially curved upper aperture 13 extends downwardly from the pair of substantially vertical channels 11, such that upon engaging the upper aperture 13, the panel support unit 30 may rest in the closed configuration until it is selectively displaced. In the closed configuration, the panel support unit 30 extends above the retail shelving system, concealing the items stored on the overhead part of the retail shelving system. Additionally, in this particular embodiment, the pair of unusually-spaced members 31 of the panel support unit 30 are substantially parallel to the plurality of mounting posts 10.

Figure 9:
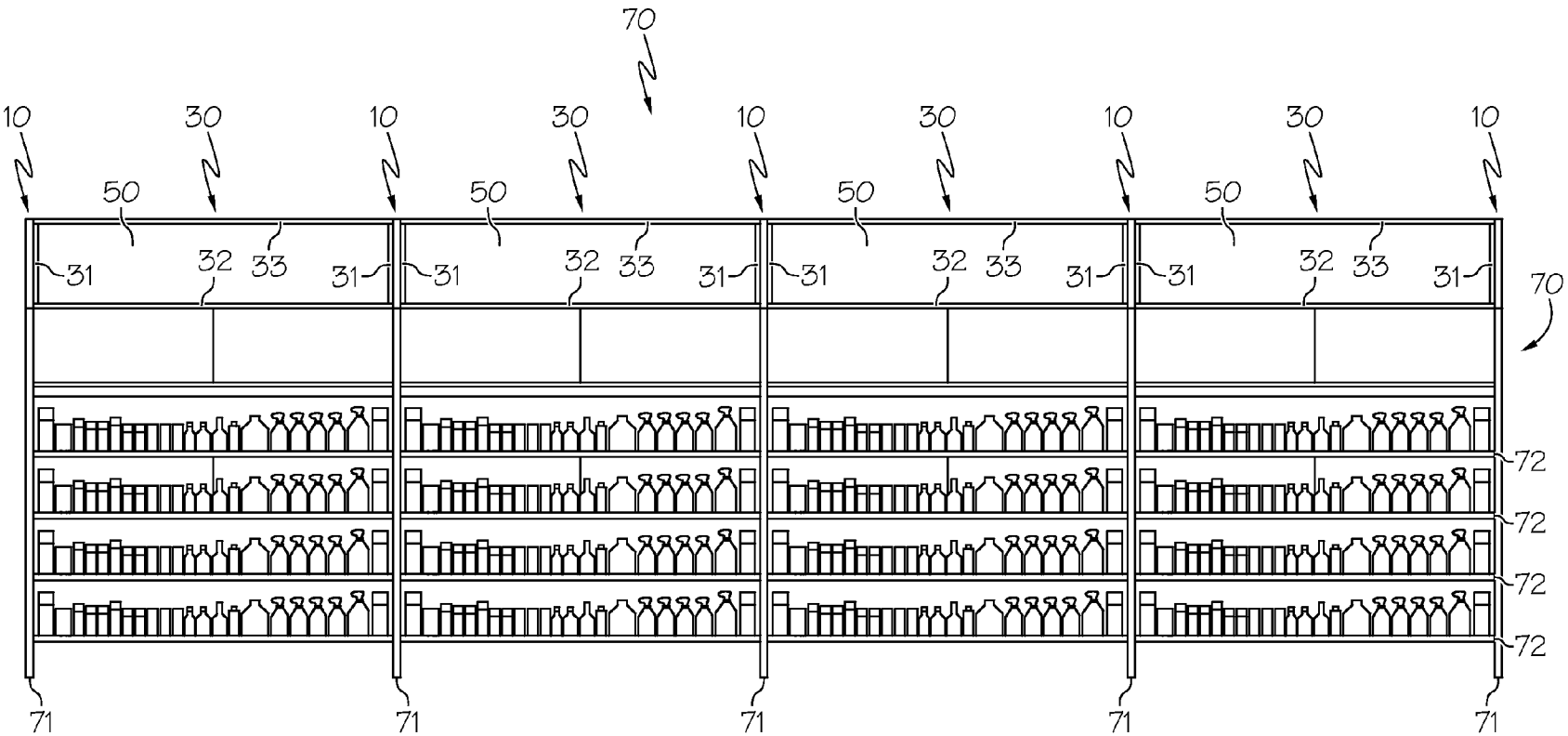
FIG. 9 is a front view of a retail shelving system, wherein panels are held within panel support units, according to one embodiment of the present invention.

As depicted in FIGS. 7 and 9, in one particular embodiment, the present invention comprises a retail shelving system 70. The retail shelving system 70 generally comprises a shelving system and the device 1 as previously described. More particularly, the retail shelving system 70 comprises a plurality of substantially vertical posts 71 attached to at least one substantially horizontal shelf 72. The plurality of substantially vertical posts 71 are substantially normal to the substantially horizontal shelf 72. The retail shelving system 70 comprises a plurality of mounting posts 10 attachable to the plurality of vertical posts of the retail shelving system 70. The retail shelving system 70 further comprises at least one panel support unit 30 configured to hold panels 50 therein.

The substantially vertical posts 71 may be attached to the substantially horizontal shelf 72 with any suitable attachment devices, including but not limited to screws, nuts, bolts, clamps, and/or welds. In an alternative embodiment, the substantially vertical posts 71 may comprise a plurality of slots wherein the substantially horizontal shelf 72 may be attached thereto.

The plurality of mounting posts 10 comprise a plurality of substantially vertical channels 11 terminating in respective ends thereof and extending in a substantially vertical direction above the retail shelving system. The panel support unit 30 is engaged with the plurality of mounting posts 10 and extends above the retail shelving system. The panel support unit 30 is selectively moveable between an open configuration and a closed configuration, such that when in the open configuration the panel support unit 30 is displaced to provide access to the items stored on the overhead part of the retail shelving system, and when in the closed configuration the panel support unit 30 conceals the items stored on the overhead part of the retail shelving system.

In one embodiment, the retail shelving system 70 comprises a plurality of mounting posts 10 attached to substantially all of the vertical posts of the retail shelving system, such that substantially all of the items stored on the overhead part of the retail shelving system will be concealed in the closed configuration. In an alternative embodiment, a plurality of mounting posts 10 are attached to a portion of the vertical posts of the retail shelving system, such that a portion of the items on the overhead part of the retail shelving system will be concealed in the closed configuration. In a further embodiment, the plurality of mounting posts 10 may engage the plurality of header members 32, 33 such that a single mounting post 10 may engage greater than one panel support unit 30. The retail shelving system 70 may conceal and provide access to substantially all or only a portion of the items stored on the overhead part of the retail shelving system.

Additionally, the panels 50 of the retail shelving system 70 may comprise a network of text, graphics, images, and/or advertisements. Thus, the retail shelving system 70 for providing selective concealment and access to items stored on an overhead part of a retail shelving system may display a cohesive network of text, graphics, images, and/or advertisements to conceal substantially all or a portion of the items stored on the overhead part of the retail shelving system. Alternatively, the retail shelving system 70 may display a cohesive network of blank panels 50.

In another embodiment, the present invention comprises a method of storing items on an overhead part of a retail shelving system 70. The method comprises providing the device 1 as previously described. More specifically, the method comprises providing a plurality of mounting posts 10 attachable to the retail shelving system 70 comprising at least one substantially vertical channel 11 terminating in respective ends thereof and extending in a substantially vertical direction above the retail shelving system 70. The method further comprises providing a panel support unit 30 configured to hold a panel 50 therein, wherein the panel support unit 30 is engaged with the plurality of mounting posts 10, and wherein the panel support unit 30 extends above the retail shelving system 70 and is selectively moveable between an open configuration and a closed configuration, wherein displacing the panel support unit 30 provides access to the items stored on the overhead part of the retail shelving system 70.

In a further embodiment, the open configuration comprises displacing the panel support unit 30 by extending a post 36 through the tab member 35 defining at least one aperture 44 therein. In still a further embodiment, the open configuration comprises displacing the panel support unit 30 by translating the pins 34 in a vertical direction through the respective vertical channels 11. In yet another embodiment, the open configuration comprises displacing the panel support unit 30 by rotating the pins 34 in a radial direction about the respective vertical channels 11.

In one embodiment of the closed configuration, the closed configuration comprises selective fixation of the panel support unit 30 such that the pins rest 34 within the vertical channels 11 terminating in respective ends thereof.

In another embodiment, the present invention relates to a method of providing selective concealment and access to items stored on an overhead part of a retail shelving system 70 which comprises utilizing the device 1 of the present invention as previously described.

For the purposes of describing and defining the present invention it is noted that the terms "about" and "substantially" are utilized herein to represent the inherent degree of uncertainty that may be attributed to any quantitative comparison, value, measurement, or other representation. The terms "about" and "substantially" are also utilized herein to represent the degree by which a quantitative representation may vary from a stated reference without resulting in a change in the basic function of the subject matter at issue.

The above description and drawings are only to be considered illustrative of exemplary embodiments, which achieve the features and advantages of the present invention. Modification and substitutions the features and steps described can be made without departing from the intent and scope of the present invention. Accordingly, the invention is not to be considered as being limited by the foregoing description and drawings, but is only limited by the scope of the appended claims.

In another aspect, the present invention relates to a method of storing items on an overhead part of a retail shelving system. The method comprises providing a plurality of mounting posts attachable to the retail shelving system comprising at least one substantially vertical channel terminating in respective ends thereof and extending in a substantially vertical direction above the retail shelving system. The method further comprises providing a panel support unit configured to hold a panel therein, wherein the panel support unit is engaged with the plurality of mounting posts, and wherein the panel support unit extends above the retail shelving system and is selectively moveable between an open configuration and a closed configuration, wherein displacing the panel support unit provides access to the items stored on the overhead part of the retail shelving system.

What is claimed is:

1. A device for providing selective concealment and access to items stored on an overhead part of a retail shelving system, the device comprising:

a plurality of mounting posts attachable to the retail shelving system, wherein each of the plurality of mounting posts extend in a substantially vertical direction above the retail shelving system and comprise a plurality of substantially vertical channels terminating in respective ends thereof, wherein each of the plurality of mounting posts comprise side walls attached to a front wall, wherein each of the side walls include one of the substantially vertical channels terminating in respective ends thereof, and wherein the respective ends of each of the substantially vertical channels terminate in a lower aperture and an upper aperture; and at least one panel support unit configured to hold a panel therein, wherein the at least one panel support unit is engaged with the plurality of mounting posts and is selectively moveable between an open configuration and a closed configuration such that:

when in the open configuration, the at least one panel support unit is displaced to provide access to the items stored on the overhead part of the retail shelving system, when in the closed configuration the at least one panel support unit conceals the items stored on the overhead part of the retail shelving system, and when attached to the retail shelving system, the lower aperture is obstructed by vertical posts of the retail shelving system and the at least one panel support unit is not engageable with the lower aperture.

2. The device of claim 1, wherein the plurality of mounting posts attachable to the retail shelving system are substantially C-shaped.

3. The device of claim 2, wherein the plurality of mounting posts define at least one aperture therein such that the plurality of mounting posts may be attached to the retail shelving system through at least one fastener coupled thereto through the at least one aperture.

4. The device of claim 1, wherein the at least one panel support unit comprises a plurality of supporting members attachable to header members.

5. The device of claim 4, wherein the plurality of supporting members are substantially parallel to one another, the header members are substantially parallel to one another, and the plurality of supporting members are substantially normal to the header members such that the at least one panel support unit is substantially rectangular.

6. The device of claim 5, wherein the header members define header member cavities, wherein the panel may be held therein.

7. The device of claim 6, wherein at least one of the header members comprises at least two pins extending outwardly from opposing ends thereof.

8. The device of claim 7, wherein the open configuration comprises displacement of the at least one panel support unit such that the at least two pins translate in a vertical direction through respective ones of the vertical channels.

9. The device of claim 7, wherein the open configuration comprises displacement of the at least one panel support unit such that the at least two pins rotate in a radial direction about respective ones of the vertical channels.

10. The device of claim 7, wherein the closed configuration comprises selective fixation of the at least one panel support unit such that the at least two pins rest within respective ones of the vertical channels terminating in respective ends thereof.

11. The device of claim 7, wherein the panel support unit comprises a tab member defining at least one aperture therein.

12. The device of claim 7, wherein the lower aperture comprises a diameter greater than a diameter of the at least two pins.

13. The device of claim 5, wherein the at least one panel support unit comprises at least one spring pad, wherein the at least one spring pad may be attached to one of the header members with at least one attachment device coupled thereto.

14. The device of claim 5, wherein the at least one panel support unit comprises at least one cable, wherein the at least one cable may be attached to the plurality of mounting posts and to the header members with at least one attachment device coupled thereto.

15. The device of claim 1, wherein the plurality of mounting posts accommodate the retail shelving system in a nested fashion when attached thereto.

16. A method of storing items on an overhead part of a retail shelving system, the method comprising:

providing a plurality of mounting posts attachable to the retail shelving system, the plurality of mounting posts comprising a plurality of substantially vertical channels terminating in respective ends thereof and extending in a substantially vertical direction above the retail shelving system, wherein each of the plurality of mounting posts comprise side walls attached to a front wall, wherein each of the side walls include one of the substantially vertical channels terminating in respective ends thereof, and wherein the respective ends of each of the substantially vertical channels terminate in a lower aperture and an upper aperture;

providing at least one panel support unit configured to hold a panel therein, wherein the at least one panel support unit is engaged with the plurality of mounting posts such that when attached to the retail shelving system, the lower aperture is obstructed by vertical posts of the retail shelving system and the at least one panel support unit is not engageable with the lower aperture, and wherein the at least one panel support unit extends above the retail shelving system and is selectively moveable between an open configuration and a closed configuration;

displacing the at least one panel support unit in order to provide access to the overhead part of the retail shelving system; and placing items in the overhead part of the retail shelving system while the at least one panel support unit is displaced.

17. The method of claim 16, wherein displacing the at least one panel support unit comprises engaging a post with a tab member defining at least one aperture therein such that upon movement of the post, the engagement of the post and the at least one panel support unit causes the at least one panel support unit to move.

18. The method of claim 17, wherein displacing the at least one panel support unit further comprises translation of at least two pins of the at least one panel support unit in a vertical direction through respective ones of the vertical channels.

19. A device for providing selective concealment and access to items stored on an overhead part of a retail shelving system, the device comprising:

a plurality of mounting posts attachable to the retail shelving system, wherein the plurality of mounting posts attachable to the retail shelving system are substantially C-shaped, wherein each of the plurality of mounting posts extend in a substantially vertical direction above the retail shelving system and comprise a plurality of substantially vertical channels terminating in respective ends thereof, wherein each of the plurality of mounting posts comprise side walls attached to a front wall, wherein each of the side walls include one of the substantially vertical channels terminating in respective ends thereof, and wherein the respective ends of each of the substantially vertical channels terminate in a lower aperture and an upper aperture; and at least one panel support unit configured to hold a panel therein, wherein the at least one panel support unit is engaged with the plurality of mounting posts and is selectively moveable between an open configuration and a closed configuration such that:

when in the open configuration, the at least one panel support unit is displaced to provide access to the items stored on the overhead part of the retail shelving system, when in the closed configuration the at least one panel support unit conceals the items stored on the overhead part of the retail shelving system, and when attached to the retail shelving system, the lower aperture is obstructed by vertical posts of the retail shelving system, the at least one panel support unit is not engageable with the lower aperture, and the plurality of mounting posts accommodate the vertical posts of the retail shelving system in a nested fashion.

* * * * *